US006580883B2

(12) United States Patent
Suzumi

(10) Patent No.: US 6,580,883 B2
(45) Date of Patent: Jun. 17, 2003

(54) IMAGE HEATING APPARATUS

(75) Inventor: Masahiko Suzumi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/989,178

(22) Filed: Nov. 21, 2001

(65) Prior Publication Data

US 2002/0094212 A1 Jul. 18, 2002

(30) Foreign Application Priority Data

Nov. 24, 2000 (JP) ..... 2000-357131

(51) Int. Cl.[7] ..... G03G 15/20; G03G 15/00

(52) U.S. Cl. ..... 399/69; 219/216; 399/33; 399/43

(58) Field of Search ..... 399/67, 68, 69, 399/33, 44, 94, 95, 43; 219/216

(56) References Cited

U.S. PATENT DOCUMENTS

| | | | | | |
|---|---|---|---|---|---|
| 4,585,325 | A | * | 4/1986 | Euler | 399/69 |
| 5,083,168 | A | | 1/1992 | Kusaka et al. | |
| 5,171,969 | A | * | 12/1992 | Nishimura et al. | 219/216 |
| 5,210,579 | A | | 5/1993 | Setoriyama et al. | |
| 5,289,247 | A | * | 2/1994 | Takano et al. | 399/68 |
| 5,669,039 | A | | 9/1997 | Ohtsuka et al. | 399/68 |
| 5,742,870 | A | * | 4/1998 | Hwang | 399/69 |
| 5,767,484 | A | | 6/1998 | Hirabayashi et al. | 219/216 |
| 5,915,146 | A | | 6/1999 | Kusaka et al. | 399/68 |
| 5,920,757 | A | | 7/1999 | Izawa et al. | 399/329 |
| 6,040,558 | A | * | 3/2000 | Yamazaki | 219/216 |
| 6,115,563 | A | * | 9/2000 | Miyamoto | 399/67 |
| 6,185,383 | B1 | | 2/2001 | Kanari et al. | 399/45 |
| 6,298,215 | B1 | * | 10/2001 | Nomura et al. | |
| 6,336,009 | B1 | | 1/2002 | Suzumi et al. | 399/67 |

FOREIGN PATENT DOCUMENTS

| | | | |
|---|---|---|---|
| JP | 63-313182 | | 12/1988 |
| JP | 2-157878 | | 6/1990 |
| JP | 0 461 595 | | 12/1991 |
| JP | 4-44075 | | 2/1992 |
| JP | 4-204980 | | 7/1992 |
| JP | 6-102794 | * | 4/1994 |
| JP | 7-13462 | * | 1/1995 |
| JP | 7-248700 | * | 9/1995 |
| JP | 10-228208 | * | 8/1998 |
| JP | 10-268692 | * | 10/1998 |
| JP | 2000-98794 | * | 4/2000 |
| JP | 2000-162907 | | 6/2000 |
| JP | 2000-162909 | | 6/2000 |
| JP | 2000-206811 | | 7/2000 |
| JP | 2000-235325 | | 8/2000 |

* cited by examiner

*Primary Examiner*—Susan S. Y. Lee
(74) *Attorney, Agent, or Firm*—Fitzpatrick, Cella, Harper & Scinto

(57) ABSTRACT

An object of the present invention is to provide an image heating apparatus for heating an image on a recording material that has a heating member, a first heat generating element mounted on the heating member, a second heat generating element mounted on the heating member, a temperature detecting element for detecting a temperature of the heating member, the temperature detecting element being disposed in an area where the recording material of a predetermined minimum size does not pass, and power supply control device for controlling electric power supply to the first and second heat generating elements in conformity with both of the detected temperature by the temperature detecting element and the number of continuously passing recording materials.

15 Claims, 9 Drawing Sheets

IMAGE HEATING APPARATUS

BACKGROUND OF THE INVENTION

1. Field of the Invention

This invention relates to an image heating apparatus such as a fixing apparatus or an apparatus for improving the surface property of an image carried on an image forming apparatus such as a copier or a printer.

2. Related Art

Apparatuses of the heat roller type and the film heating type have heretofore been widely used as fixing apparatuses used in image forming apparatuses of the electrophotographic type, the electrostatic recording type, etc. Particularly, a method of minimizing electric power consumption to the utmost without supplying electric power to a fixing apparatus during standby, and more particularly a heating and fixing method by a film heating system of heating and pressurizing a recording material while passing the recording material to a nip area formed by a pressure member being in pressure contact with a heating member with a film member interposed therebetween to thereby fix a toner image on the recording material as an unfixed image on the recording material are proposed in Japanese Patent Application Laid-Open No. 63-313182, Japanese Patent Application Laid-Open No. 2-157878, Japanese Patent Application Laid-Open No. 4-44075, Japanese Patent Application Laid-Open No. 4-204980, etc.

FIG. 10 of the accompanying drawings schematically shows the construction of the essential portions of an example of the fixing apparatus adopting the film heating process.

Such a fixing apparatus, as shown in FIG. 10, has a heater 111 which is a heating member fixedly supported by a stay holder (supporting body) 112, fixing film 113 which is a thin and heat-resistant film member, and an elastic pressure roller 120 which is a pressure member brought into pressure contact with the heater 111 with the film member 113 interposed therebetween to thereby form a nip area (hereinafter referred to as the fixing nip portion) N of a predetermined nip width.

The fixing film 113 is a cylindrically shaped or endless-belt-shaped or rolled web-shaped member conveyed in the direction of arrow a by driving means (not shown) or the rotational force of the pressure roller 120 while being in close contact with the surface of the heater 111 in the fixing nip portion N.

The heater 111 receives the supply of electric power from a power source (not shown) and generates heat and is controlled to a predetermined temperature.

When in a state in which the heater 111 has been heated and controlled to the predetermined temperature and the fixing film 113 has been conveyed in the direction of arrow, a recording material P bearing an unfixed toner image t thereon as a material to be heated is introduced between the fixing film 113 in the fixing nip portion N and the pressure roller 120, the recording material P comes into close contact with the surface of the fixing film 113 and is nipped and conveyed by the fixing nip portion N with the fixing film 113. In this fixing nip portion N, the recording material P and the toner image t are heated by the heater 111 through the fixing film 113 and the toner image t on the recording material P is fixed. That portion of the recording material P which has passed through the fixing nip portion N is peeled off from the surface of the fixing film 113 and is conveyed.

A ceramic heater is generally used as the heater 111 as a heating member. For example, the heater 111 comprises a substrate 111*a* made of ceramics having electrically insulativeness, good heat conductivity and low heat capacity such as alumina, and a heat-generating resistance layer 111*b* of silver palladium (Ag/Pb), $Ta_2N$ or the like formed on the surface (the surface facing the fixing film 13) of the substrate 111*a* along the lengthwise direction (a direction perpendicular to the conveying direction of the recording material P) of the substrate 111*a* as by screen printing, that surface of the substrate 111*a* on which the heat-generating resistance layer 111*b* is formed being covered with a thin glass protective layer 111*c*.

This heater 111 which is a ceramic heater is such that by electric power being supplied to the heat-generating resistance layer 111*b*, the heat-generating resistance layer 111*b* generates heat and heat the substrate 111*a* made of ceramics and the glass protective layer 111*c* and the entire heater 111 rapidly rises in temperature. This temperature rise of the heater 111 is detected by temperature detecting means 114 disposed on the back of the heater 111 and is fed back to a power supply control portion (not shown) which is control means. The power supply control portion controls the electric power supplied to the heat-generating resistance layer 111*b* so that the temperature of the heater 111 detected by the temperature detecting means 114 may be maintained at a predetermined substantially constant temperature (fixing temperature). In this manner, the heater 111 is heated and controlled to the predetermined fixing temperature.

The fixing film 113 has its thickness formed considerably small, e.g. to 20 to 70 $\mu$m, in order to efficiently give the heat of the heater 111 to the recording material P as the material to be heated in the fixing nip portion N. This fixing film 113 is formed by three layers, i.e., a film base layer, a primer layer and a releasing property layer, and the film base layer side is the heater 111 side and the releasing property layer side is the pressure roller 120 side. The film base layer is formed of polyimide, polyamideimide, PEEK or the like higher in insulativeness than the glass protective layer 111*c* of the heater 111, and has heat resistance and high elasticity. Also, the mechanical strength such as the tearing strength of the entire fixing film 113 is kept by the film base layer. The above-mentioned primer layer is formed by a thin layer having a thickness of the order of 2 to 6 $\mu$m. The above-mentioned releasing property layer is a toner offset preventing layer for the fixing film 113, and is formed by coating the primer layer with fluorine resin such as PFA, PTFE or FEP to a thickness of the order of 10 $\mu$m.

Also, the stay holder 112 is formed, for example, by a member made of heat-resistant plastic, and holds the heater 111 and serves also as the conveyance guide of the fixing film 113.

In a heating apparatus of the film heating type using such thin fixing film 113, due to the high rigidity of the heater 111 made of ceramics, the pressure roller 120 having an elastic layer 122 becomes flat in the pressure contact portion thereof, following the flat underside of the heater 111 with which it is brought into pressure contact, and formes the fixing nip portion N of a predetermined width, and only the fixing nip portion N is heated to thereby realize heating and fixing of quick start.

In the fixing apparatus of the above-described construction, the disposition relation between the heat-generating resistance layer 111*b* of the heater 111 and the pressure roller 120 will now be described with reference to FIG. 11 of the accompanying drawings.

As shown in FIG. 11, the width W of the heat-generating resistance layer 111*b* of the heater 111 in the longitudinal direction thereof is somewhat narrow as compared with the width D of the elastic layer 122 of the pressure roller 120 brought into contact therewith with the fixing film 113 interposed therebetween in the same direction. This is for preventing the heat-generating resistance layer 111*b* from protruding from the pressure roller 120 in the same direction to thereby locally rise in temperature and be damaged by the thermal stress thereof. Also, the heat-generating resistance layer 111*b* is formed with a width sufficiently wider than the sheet passing area of the recording material P bearing the toner image t thereon. Thereby, the temperature fall of the end portions (due to the leakage of the heat to electrical contacts for power supply and connectors in the lengthwisely end portions of the heater 111) can be eliminated, whereby a good fixing property is obtained over the whole surface of the recording material P. Further, there is a case where the width of the sheet passing area end portions of the heat-generating resistance layer 111*b* is narrowed down and the amount of heat generation in the end portions is increased to thereby make up for the fixing property of the end portions.

Thereby, the heat from the heat-generating resistance layer 111*b* of the heater 111 is given to the recording material P conveyed between the fixing film 113 and the pressure roller 120, and acts to fuse and fix the toner image t on the recording material P.

Also, the present example is a center standard apparatus in which a recording material conveyance standard S is provided at the lengthwise center of the recording material passing area of the main body of an image forming apparatus.

Further, as shown in FIG. 11, temperature detecting means 114 such as a thermistor and a thermoprotector 115 such as a temperature fuse or a thermoswitch for shutting down the supply of electric power to the heat-generating resistance layer 111*b* of the heater 111 during speeding are brought into contact with the back of the heater 111, and these are disposed in the conveyance area of a recording material P of a definite size having a minimum width (within the minimum sheet passing width) which can be conveyed by the image forming apparatus.

The temperature detecting means 114 is provided within the minimum sheet passing width in order to heat and fix the toner image t on the recording material P at a moderate fixing temperature without causing a problem such as bad fixing or high temperature offset even when a recording material P of a minimum width which can be conveyed by the main body of the image forming apparatus is conveyed. On the other hand, the thermoprotector 115 is also provided within the minimum sheet passing width in order not to cause, in the non-sheet-passing area when the recording material P of the minimum width is conveyed, the problem that the recording material is overheated in the non-sheet-passing area smaller in heat resistance than the sheet-passing area, whereby even during ordinary conveyance, the thermoprotector 115 malfunctions and the power supply is shut out.

Now, the thermoprotector 115 is brought into contact with the back of the heater 111, whereby the amount of heat generated by the heat-generating resistance layer 111*b* is taken away by the thermoprotector 115 and a sufficient amount of heat is not given to the recording material P, and bad fixing is sometimes caused at the contact position of the thermoprotector 115. In order to prevent this, at the position 111*b*' of the heat-generating resistance layer 111*b* corresponding to the contact position of the thermoprotector 115, as shown in FIG. 11, the width of a portion of the heat-generating resistance layer 111*b* of the heater 111 is somewhat narrowed and the resistance value of the above-mentioned contact position is made greater than that of the other portion to thereby secure an amount of heat generation. Thereby the amount of heat supply to the recording material P is made constant over the lengthwise direction and good heating and fixing free of uneven fixing are realized. The temperature detecting means 114 is likewise brought into contact with the back of the heater 111 and therefore, it is feared that the heat generated by the heat-generating resistance layer 111*b* is likewise taken away by the temperature detecting means 114, but by using temperature detecting means 114 of a small heat capacity such as a chip thermistor, it is possible to make the amount of heat taken away from the heater Ill small. Therefore, even if the countermeasure as described above similar to that for the thermoprotector 115 is not adopted, uniform fixing becomes possible without spoiling the uniformity of fixing of the recording material in the lengthwise direction thereof.

In the above-described conventional fixing apparatus, when recording materials of different sizes (sheet widths) are continuously passed to the nip area, the amount of heat taken away from the heater by the sheet passing differs greatly between the sheet passing portion and the non-sheet-passing portion and therefore as the sheets are passed, the temperature of the non-sheet-passing portion of which the amount of heat is not taken away by the sheets gradually rises (hereinafter referred to as the temperature rise of the non-sheet-passing portion). Therefore, during the passing of a small size sheet, this problem has been coped with by a method of reducing the throughput (number of sheets conveyed per unit time). As the method of reducing the throughput, there is adopted a method of uniformly reducing the throughput for a number of sheet free of any problem even under a condition under which the temperature rise of the non-sheet-passing portion is worst (thick paper of a small size or the like), or a method of providing a temperature detecting member such as a thermistor in the non-sheet-passing portion, and reducing the throughput when it rises to a predetermined temperature.

However, when a great deal of small size sheets are continuously passed to the fixing nip portion, the temperature of the non-sheet-passing portion moves to the downstream side of the fixing nip portion with respect to the sheet passing direction due to the rotation of the pressure roller and a high temperature portion is formed. This high temperature portion expedites the wear of the surface and inner surface of the fixing film, and there may occur the offset image by a reduction in the releasing property of the surface of the fixing film or the bad paper conveyance (such as slippage or jam) by an increase in the sliding resistance of the film.

Also, in order to more positively suppress the temperature rise of the non-sheet-passing portion and improve the capability of continuously fixing small size paper, there has been adopted a method called zone heating which is to provide a plurality of heat generating members corresponding to paper sizes, and change over the heat generating members in conformity with the paper sizes. In this method, in order to secure the fixing property of large size sheets after the passing of small size sheets, there is adopted a construction for warming up the non-sheet-passing portion at a predetermined percentage even during the passing of small size sheets and therefore, when a great deal of small size sheets are passed, there is the possibility that the temperature of the non-sheet-passing portion gradually rises and damage similar to that described above is given to the fixing film and offset images or bad conveyance (such as slip jam) occurs.

SUMMARY OF THE INVENTION

The present invention has been made in view of the above-noted problem and an object thereof is to provide an image heating apparatus which can suppress the excessive temperature rise of a non-sheet-passing portion.

Another object of the present invention is to provide an image heating apparatus which can suppress the damage of the apparatus.

Still another object of the present invention is to provide an image heating apparatus comprising:

a heating member;

a first heat generating element mounted on the heating member;

a second heat generating element mounted on the heating member;

a temperature detecting element for detecting the temperature of the heating member, the temperature detecting element being disposed in an area where a recording material of a predetermined minimum size does not pass; and power supply control means for controlling electric power supply to the first and second heat generating elements in conformity with both of the detected temperature by the temperature detecting element and the number of continuously passing recording materials.

Yet still another object of the present invention is to provide an image heating apparatus comprising:

a heating member;

a first heat generating element mounted on the heating member; and a second heat generating element mounted on the heating member;

wherein when the temperature of that area of the heating member where a recording material of a predetermined minimum size does not pass is lower than a predetermined temperature, the first and second heat generating elements generate heat, and when the temperature of the area becomes higher than the predetermined temperature and the number of continuously passing recording materials becomes greater than a predetermined number, the first heat generating element continues to generate heat and the second heat generating element stops generating heat.

A further object of the present invention is to provide an image heating apparatus comprising:

a heating member;

a first heat generating element mounted on the heating member; and a second heat generating element mounted on the heating member, the width of the second heat generating element in the longitudinal direction thereof being substantially equal to that of the first heat generating element;

wherein when the temperature of that area of the heating member where a recording material of a predetermined minimum size does not pass is lower than a predetermined temperature, the first and second heat generating elements generate heat, and when the temperature of the area is higher than the predetermined temperature, the second heat generating element does not generate heat, but the first heat generating element generates heat.

Still a further object of the present invention is to provide an image heating apparatus comprising:

a heating member;

a plurality of heat generating elements mounted on the heating member;

transfer control means for controlling the transfer of recording materials, the transfer control means decreasing the number of sheets conveyed per unit time when the temperature of that area of the heating member where a recording material of a predetermined minimum size does not pass rises; and power supply control means for controlling electric power supply to the plurality of heat generating elements, the power supply control means decreasing the number of heat generating elements which generate heat when the temperature of the area of the heating member rises.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the accompanying drawings.

(First Embodiment)

A first embodiment of the present invention will first be described.

Figure 1:
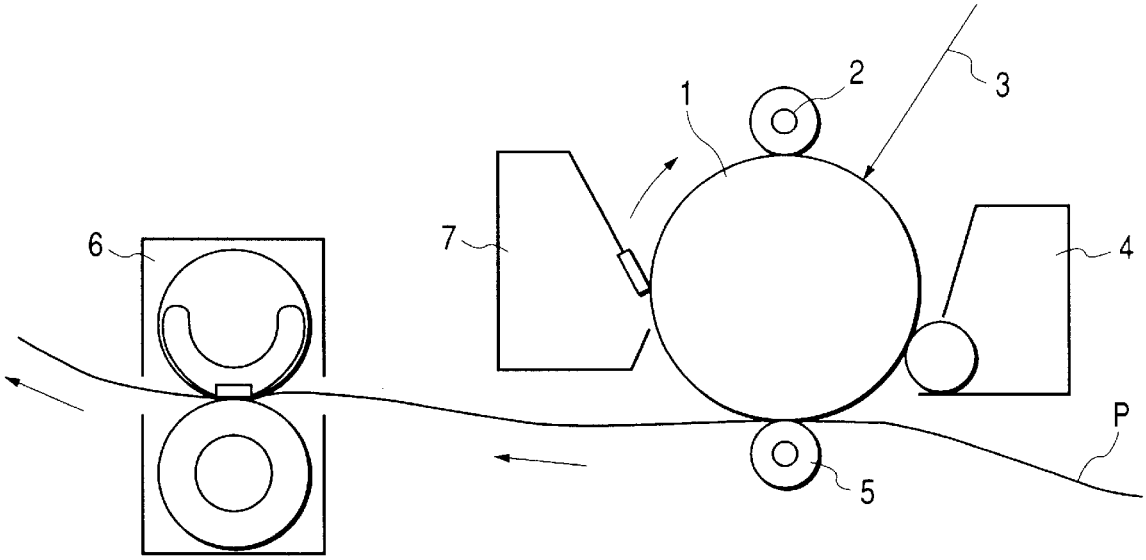
FIG. 1 is a typical cross-sectional view schematically showing the construction of an image forming apparatus according to a first embodiment of the present invention.

FIG. 1 is a typical cross-sectional view schematically showing the construction of an image forming apparatus according to the present embodiment.

Such an image forming apparatus, as shown in FIG. 1, is provided with a photosensitive drum 1 comprising a cylindrical base of aluminum, nickel or the like and a photosensitive material such as OPC, amorphous Se or amorphous Si formed thereon.

In such an image forming apparatus, the photosensitive drum 1 is first rotatively driven in the direction of arrow, and the surface of the photosensitive drum 1 is uniformly charged by a charging roller 2 as a charging apparatus. Next, the surface of the photosensitive drum 1 is subjected to scanning exposure by a laser beam 3 ON/OFF-controlled in conformity with image information, whereby an electrostatic latent image is formed thereon. This electrostatic latent image is developed and visualized by a developing apparatus 4. As the developing method, use is made of the jumping developing method, the two-component developing method, the FEED developing method or the like, and image exposure and reversal development are often used in combination.

The toner image visualized by the developing apparatus 4 is transferred from the photosensitive drum 1 onto a recording material P conveyed at predetermined timing, by a transferring roller 5 as a transferring apparatus. At this time, the recording material P is nipped and conveyed with a constant pressure force by the photosensitive drum 1 and the transferring roller 5.

The recording material P to which the toner image has been transferred is conveyed to a fixing apparatus 6, where the toner image is fixed as a permanent image on the recording material P. On the other hand, any residual toner remaining on the photosensitive drum 1 after the transfer is removed from the surface of the photosensitive drum 1 by a cleaning apparatus 7.

Figure 2:
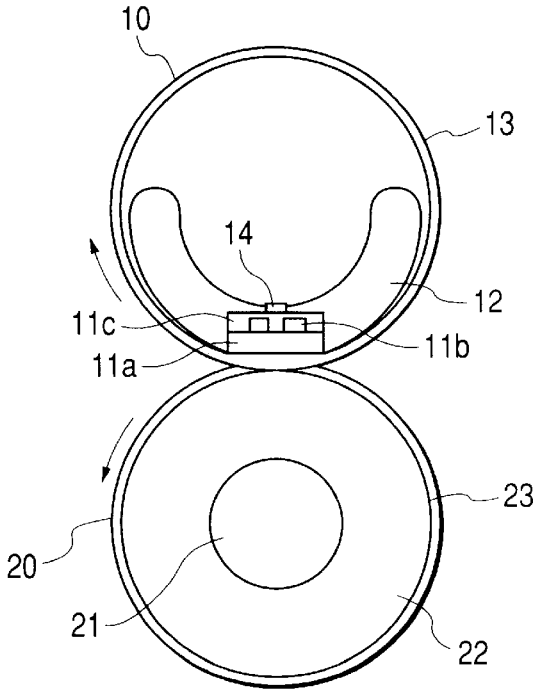
FIG. 2 is a typical cross-sectional view schematically showing the construction of a fixing apparatus provided in the image forming apparatus of FIG. 1.

FIG. 2 is a typical cross-sectional view schematically showing the construction of the fixing apparatus 6 provided in the image forming apparatus according to the present embodiment.

The fixing apparatus 6, as shown in FIG. 2, is provided with a fixing member 10 and a pressure roller 20 which is a pressure member brought into pressure contact with the fixing member 10.

The fixing member 10 has fixing film 13 which is a film member of small heat capacity, a heater 11 which is a heating member provided in the fixing film 13, and an adiabatic stay holder 12 for preventing radiation in a direction opposite to a fixing nip portion N.

The fixing film 13 is film of polyimide, polyamideimide, PEEK, PES, PPS, PFA, PTFE, FEP or the like having a thickness of 100 $\mu$m or less and heat resistance and thermoplasticity in order to make quick start possible. Also, it requires a thickness of 20 $\mu$m or greater as film having sufficient strength to constitute a heating and fixing apparatus of long life and excellent in durability. Consequently, the thickness of the fixing film 13 may optimally be equal to or greater than 20 $\mu$m and equal to or less than 100 $\mu$m. Further, in order to prevent offset and secure the separability of the recording material, the surface layer of the fixing film 13 is mixed with or singly covered with heat-resisting resin of a good releasing property such as PFA, PTFE or FEP.

The heater 11 receives electric power from a power source (not shown) and generates heat, and the temperature of a sheet passing area is detected by a first temperature detecting element (thermistor) 14, and the electric power supply from the above-mentioned power source is controlled by electric power supply control means so that the aforementioned temperature may become a predetermined fixing temperature.

The fixing temperature is set in conformity with both of a sheet size and the number of continuously printed sheets. For example, in the case of A4 size, the fixing temperature for the first printed sheet is set to 220° C., and the fixing temperature is designed to be set to 205° C. when 10 sheets are printed, and be lowered by 5° C. each time 10 sheets are printed thereafter, and be lowered finally to 190° C. In the case of B5 size, the fixing temperature starts from 215° C. and is set up to 190° C. In the case of envelopes, the fixing temperature starts from 220° C. and is set up to 200° C. The timing at which the fixing temperature is lowered (the number of continuously printed sheets) may differ for each sheet size.

By such basic control, the heating of the nip portion for fusing and fixing the toner image on the recording material is effected. Also, the heater 11 has a substrate 11*a* formed of $Al_2O_3$ or AlN which is high in heat conductivity, a heat-generating resistance layer 11*b* and a thin glass protective layer 11*c*. In the present embodiment, a heater of the back heating type is used. Also, the heat-generating resistance layer 11*b* of the heater 11 has two heat generating bodies 111*b*, and 11$b_3$ for ordinary size sheets and a heat generating body 11$b_2$ for small size sheets. The heat generating bodies 11$b_1$ and 11$b_3$ are substantially equal in length to each other.

The stay holder 12 is formed of liquid crystal polymer, phenol resin, PPS, PEEK or the like, and holds the heater 11, and the fixing film 13 is loosely fitted thereon with a margin and is disposed for rotation in the direction of arrow. Also, the fixing film 13 is rotated while rubbing against the heater 11 and stay holder 12 therein and therefore, the frictional resistance between the heater 11 and the fixing film 13 and between the stay holder 12 and the fixing film 13 need be made small. Therefore, a small amount of lubricant such as heat-resistant grease is interposed between the heater 11 and the surface of the stay holder 12. Thereby, it becomes possible for the fixing film 13 to be smoothly rotated.

The pressure roller 20 has a mandrel 21 and an elastic layer 22 formed on the outer periphery thereof by foaming heat resisting rubber such as silicon rubber or fluorine rubber or silicone rubber, and further a releasable layer of PFA, PTFE, FEP or the like may be formed on the elastic layer 22. Also, the pressure roller 20 is sufficiently pressurized toward the fixing member 10 by pressing means (not shown) to form a nip area necessary for heating and fixing from the lengthwisely opposite end portions thereof, and is rotatively driven in the direction of arrow with the rotative driving force from driving means (not shown) transmitted to the lengthwise end portions of the mandrel 21. Thereby, the fixing film 13 is driven to rotate in the direction of arrow outside the stay holder 12 by the pressure roller 20. Alternatively, a drive roller (not shown) may be provided in the fixing film 13 and the fixing film 13 may be rotated by the rotative driving force from the drive roller.

The process speed of the image forming apparatus according to the present embodiment is 151 mm/s and the maximum throughput thereof is 24 ppm (A4).

Figure 3:
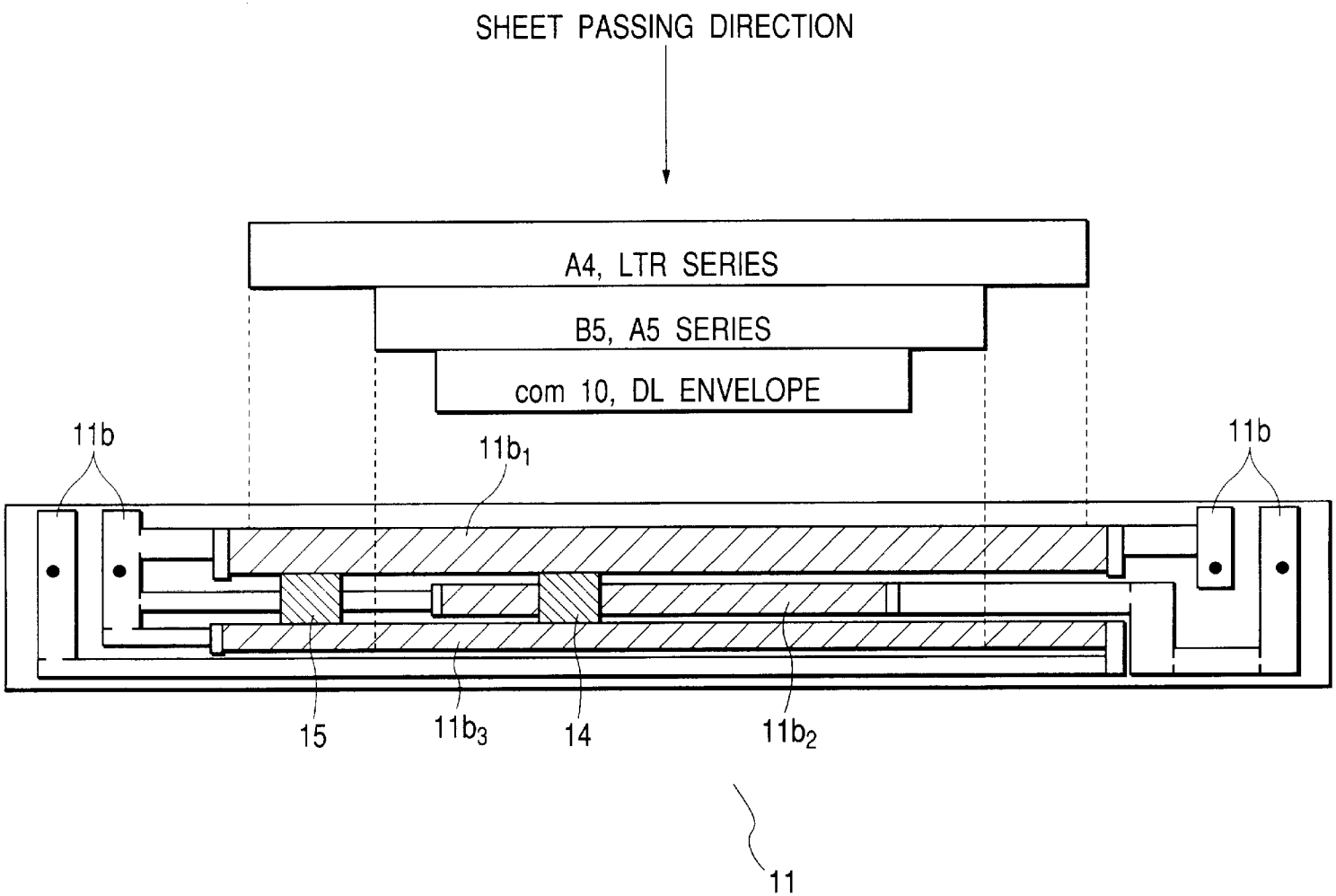
FIG. 3 schematically shows the construction of a heating member provided in the fixing apparatus of FIG. 2.

The heater 11 in the present embodiment, as shown in FIG. 3, has the heat generating bodies 11$b_1$ and 11$b_3$ (of a length 224.8 mm) for wide paper such as A4 or LTR, and the heat generating body 11$b_2$ (of a length 112 mm) for envelopes such as com 10 and DL. The reason why the heater 11 has two heat generating bodies (11$b_1$ and 11$b_3$) for A4 or LTR is for shifting the electric power supply phases of the two heat generating bodies and decreasing the current value flowing at a time to thereby reduce electrical noise (flicker and harmonic distortion).

Description will now be made of the control of suppressing the excessive temperature rise of the non-sheet-passing area of the fixing device.

The fixing device in the present embodiment prevents the excessive temperature rise of the non-sheet-passing area by the following three kinds of independent control.

The first control is to control the electric power supply to the above-described two kinds of heat generating bodies ((11$b_1$, 11$b_3$) and (11$b_2$)) in conformity with the width of the recording material.

Figure 5:
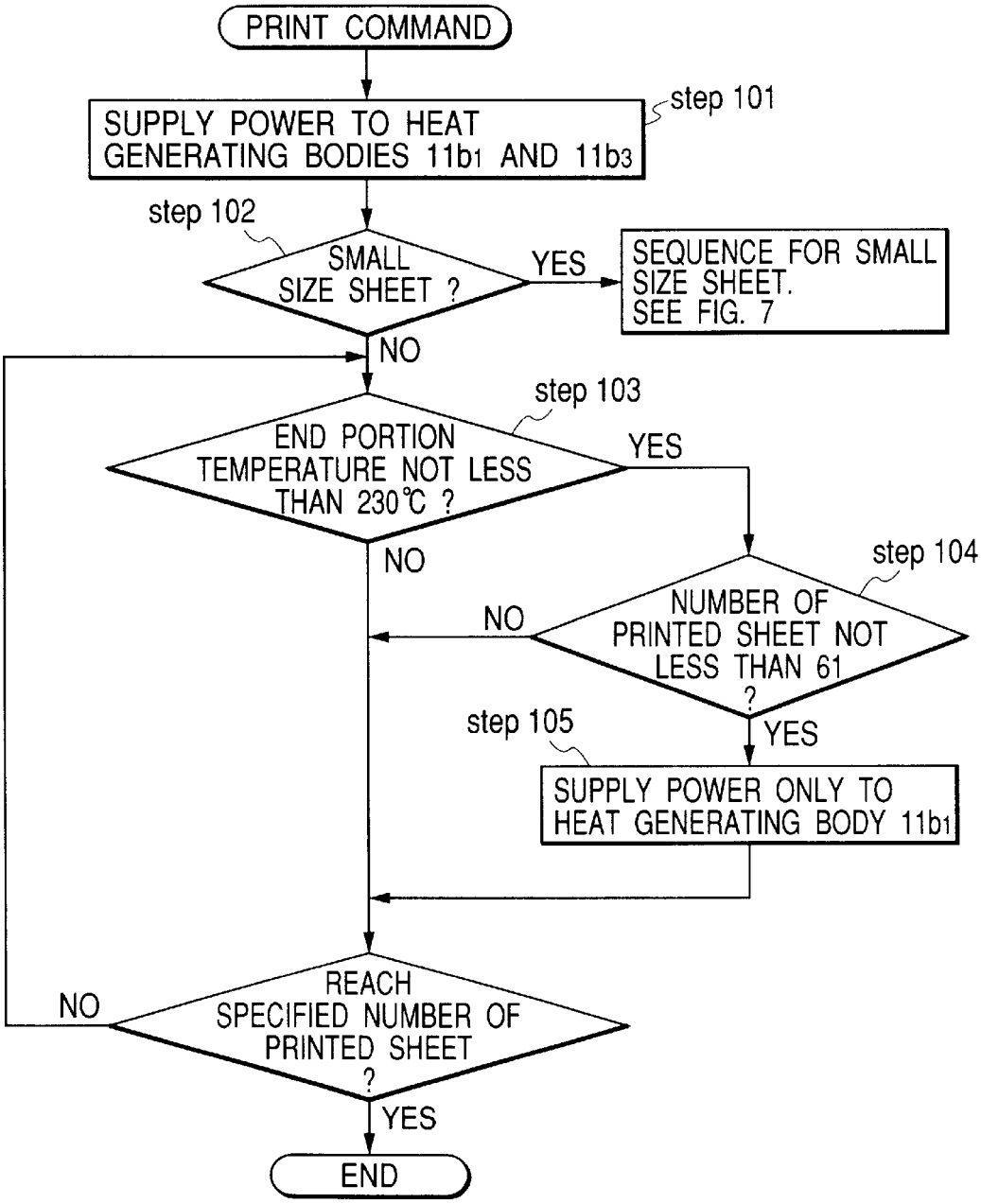
FIG. 5 is a flow chart for illustrating the drive control of each heat generating body of a heating member in the first embodiment of the present invention.

A sheet width sensor (not shown) for detecting the width of the recording material is provided in the conveying path of the recording material from the sheet feeding portion to the fixing device. The electric power supplied to the above-described two kinds of heat generating bodies ((11$b_1$, 11$b_3$) and (11$b_2$)) is controlled in conformity with the detected width by the sheet width sensor. If the recording material is a small size sheet (con 10, DL), electric power is supplied to 11$b_1$ and 11$b_2$ (the step 203 of FIG. 7), and if the recording material is of other size (any size larger than the small size), electric power is supplied to 11$b_1$ and 11$b_3$ (FIG. 5).

Also, the non-sheet-passing area of the heater 11 is temperature-detected by a second temperature detecting element (thermistor) 15. The second control is to control the throughput (the number of recording materials conveyed per unit time) in conformity with the detected temperature by this second temperature detecting element.

If the recording material is of other size (particularly B5 size or A5 size) than the small size sheet (com 10, DL), when the detected temperature by the thermistor 15 reaches 230° C., the throughput is dropped from 24 ppm to 20 ppm, and when the detected temperature reaches 240° C., the throughput is dropped from 20 ppm to 15 ppm, and when the detected temperature reaches 260° C., the throughput is dropped from 15 ppm to 10 ppm, and when the detected temperature reaches 270° C., the throughput is dropped to 6 ppm. The throughput is not dropped to below 6 ppm.

In the case of a small size sheet (com 10, DL), 24 ppm is maintained. However, as in the case of any other size than the small size sheet, the throughput may be dropped as the detected temperature by the thermistor 15 rises. Also, while in the present embodiment, in both of the case of the small size sheet and the case of any other size, the maximum throughput is 24 ppm, the maximum throughput in the case of the small size sheet may be set low (e.g. to 20 ppm).

Figure 4:
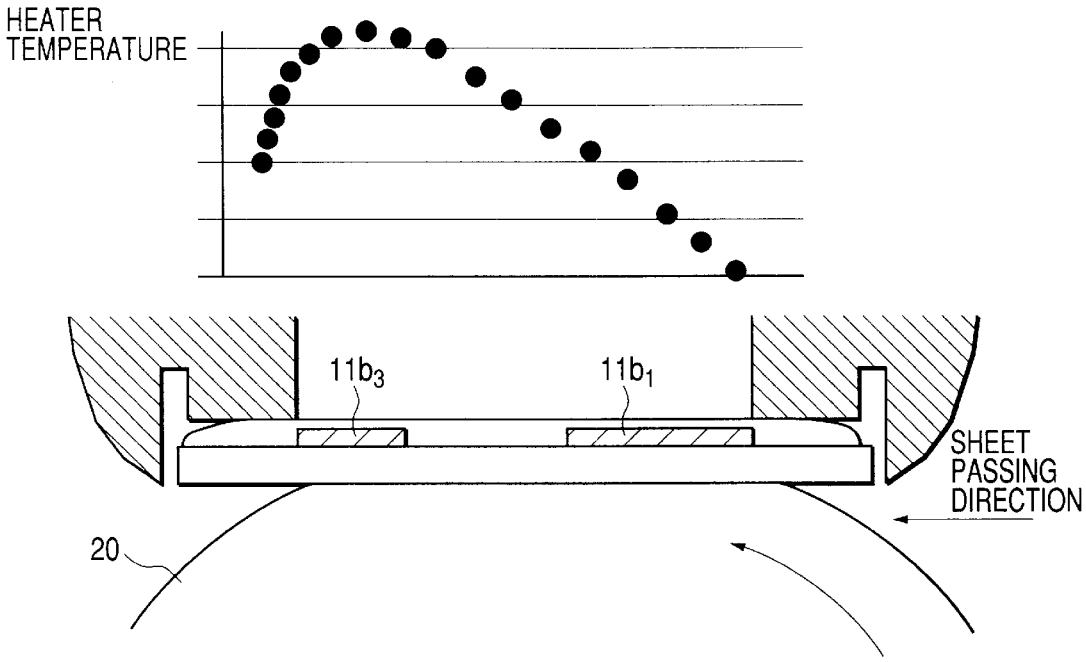
FIG. 4 shows the temperature distribution in the conveying direction of a recording material in a nip area during the continuous fixing process of small size sheets in the conventional art.

However, when a great deal of B5 size and A5 size sheets are continuously passed to the fixing nip portion N, the heat of the non-sheet-passing portion of the heater 11 moves to the downstream side of the fixing nip portion N with respect to the sheet passing direction by the rotation of the pressure roller 20, and a temperature distribution as shown in FIG. 4 is brought about. By this high temperature portion downstream of the fixing nip portion N with respect to the sheet passing direction, the wear of the surface layer and inner surface of the fixing film 13 is expedited, and offset by a reduction in the releasing property of the surface layer of the fixing film and bad conveyance (slip jam or the like) by the bad sliding movement of the inner surface of the fixing film 13 may occur.

There is a case where the temperature rise of the non-sheet-passing area cannot be suppressed by only the above-described first control and second control.

So, in the present embodiment, as the third control, the control of changing over the heat generating bodies supplied with electric power during the sheet passing of the fixing nip portion N from 11$b_1$ and 11$b_3$ to 11$b_1$ only is effected for B5 and A5 size sheets by the information of the detected temperature by the end portion thermistor 15 and the information of the number of printed sheets (the frequency of the fixing process). That is, the number of heat generating bodies (of the same length) is decreased in conformity with the temperature state of the non-sheet-passing area.

The algorism of the changeover control of the heat generating bodies in the present embodiment will now be described with reference to FIG. 5.

Electric power is first supplied to the heat generating bodies 11$b_1$ and 11$b_3$ to heat the fixing nip portio N efficiently and the fixing apparatus 6 is started (step 101). Thereafter, if the sheet width detected by the above-described sheet width sensor is judged to be a large size sheet (other than com 10, DL, etc.) (step 102), heating and fixing are effected with electric power supplied to the heat generating bodies 11$b_1$ and 11$b_3$ (first control). Next, whether the temperature detected by the end portion thermistor 15 during printing exceeds a threshold value temperature T (230° C.) which is the set temperature is judged (step 103), and if it exceeds T, whether the number of printed sheets (the number of continuously printed sheets) is not less than the set number (in the present embodiment, 61 sheets) is judged (step 104). When the above-described two conditions are satisfied, the electric power supplied to the heat generating body 11$b_3$ downstream of the fixing nip portion N with respect to the sheet passing direction is cut and only the heat generating body 11$b_1$ is changed over to the electric power supplied state (step 105).

Figure 6:
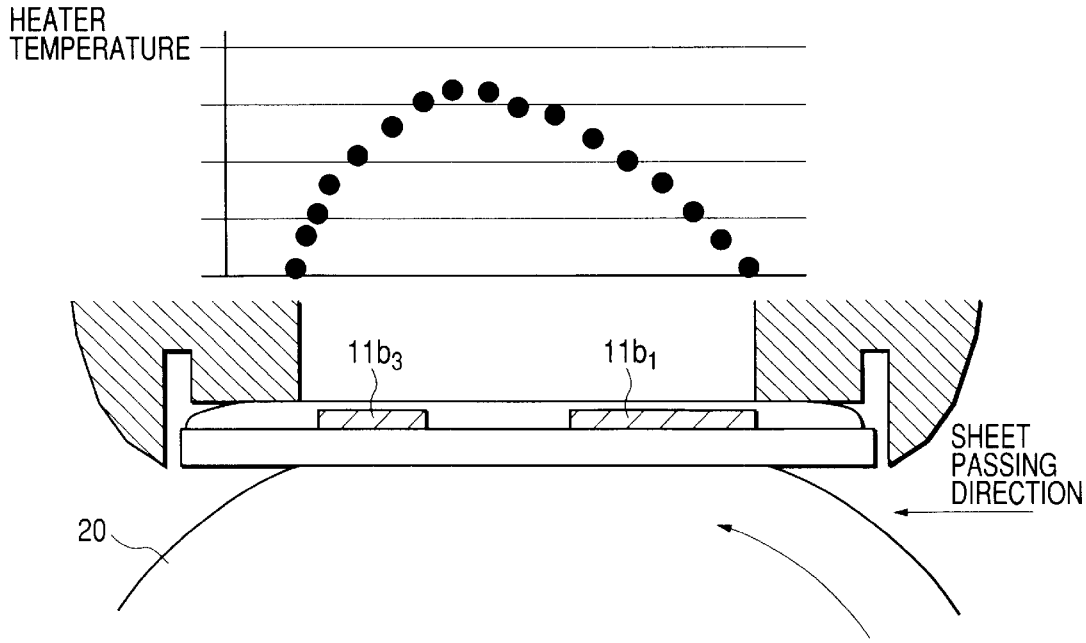
FIG. 6 shows the temperature distribution in the conveying direction of the recording material in the nip area during the continuous fixing process of small size sheets in the first embodiment of the present invention.

By the above-described control in the present embodiment, the temperature of the non-sheet-passing portion downstream of the fixing nip portion N with respect to the sheet passing direction during the printing of sheets of B5 and A5 series size can be lowered, as shown in FIG. 6. That is, by this third control, the peak temperature of the non-sheet-passing area can be lowered.

The result of a test in which the passage endurance of sheets of B5 and A5 sizes was measured by such control is shown in Table 1 below.

TABLE 1

| number of passed sheets | not controlled | controlled |
|---|---|---|
| 50k sheets | ○ | ○ |
| 100k sheets | Δ | ○ |
| 150k sheets | Δ | ○ |
| 200k sheets | x | ○ |

Table 1 above shows the result regarding the offset and the slip jam level, and x indicates "bad", Δ indicates "somewhat bad", and ○ indicates "good".

As can be seen from Table 1, by such control being effected, the durability when sheets of B5 and A5 series small size were continuously passed to the fixing nip portion N is improved. Also, as the result of the evaluation of the fixing property, in a state in which the fixing apparatus was sufficiently warmed with not less than 61 sheets printed, a good fixing property could be obtained even by the electric power supply to only the heat generating body 11$b_1$.

Particularly, the electric power supply to the heat generating body 11$b_3$ downstream with respect to the sheet passing direction is cut and therefore, the effect of lowering the temperature peak of the non-sheet-passing area is high.

While in the above-described embodiment, both of the detected temperature by the second thermistor 15 and the number of continuously printed sheets are used to judge the temperature of the non-sheet-passing area, only one of them may be used. While for example, the threshold value temperature of the non-sheet passing area is set to 230° C., this temperature may be set to a little higher temperature (e.g. 240° C.) and the heat generating bodies supplied with electric power when the temperature is exceeded 240° C. may be changed from 11$b_1$ and 11$b_3$ to 11$b_1$ only. When only the number of continuously printed sheets is used to judge the temperature of the non-sheet-passing area, the threshold value number of sheets can be set to a number for which the non-sheet-passing area has reliably risen in temperature. In this case, the temperature rise state of the non-sheet-passing area differs depending on the kind of the sheet and therefore, it is better to set the threshold value number of sheets in conformity with the kind of the sheet.

However, as described above, when the number of continuously printed sheets is increased, the temperature peak of the non-sheet-passing area in the sheet passing direction moves to the downstream size of the nip and therefore, it is difficult to detect this temperature peak accurately by the thermistor 15 disposed substantially centrally of the heater 11 with respect to the sheet passing direction. Accordingly, to judge the temperature of the non-sheet-passing area, it is most preferable to use both of the detected temperature by the second thermistor 15 and the number of continuously printed sheets as in the above-described embodiment.

While the present embodiment has been described with respect to a printer in which the maximum sheet passing width is A4, LTR series, the present invention can also be applied to printers in which the maximum sheet passing width is A3 or a larger size.

(Second Embodiment)

A second embodiment of the present invention will now be described. In the second embodiment, members similar to those in the first embodiment are given the same reference characters and need not be described.

In the present embodiment, description will be made of the changeover control of the heat generating bodies 11$b_1$, 11$b_2$ and 11$b_3$ during zone heating using the heat generating body 11$b_2$ exclusively for use for small size sheets such as com 10 and DL envelopes. The other conditions are similar to those in the aforedescribed embodiment.

When small size sheets such as com 10 and DL envelopes are to be printed, electric power is supplied to the heat generating body 11$b_2$ corresponding to the width of the small size sheets and at the same time, electric power is also supplied to the heat generating body 11$b_1$ for large size sheets to thereby secure the fixing property of the large size sheets after the printing of the small size sheets. In this case, it is suitable to set the heat generating ratio between the sheet passing portion and the non-sheet-passing portion (sheet passing portion/non-sheet-passing portion) to the order of 1.4 to 5.0. However, even when zone heating is effected as described above, if com 10, DL envelopes, etc. are passed in a great deal, there is the possibility that the temperature of the non-sheet-passing portion gradually rises and this may give damage to the fixing film as in the above-described embodiment.

So, in the present embodiment, as third control, the control of the ratio between the amounts of electric power supplied from the power source to the heat generating bodies 11$b_1$ and 11$b_2$ is effected corresponding to both of the information of the temperature detected by the end portion thermistor 15 and the information of the number of printed sheets.

Figure 7:
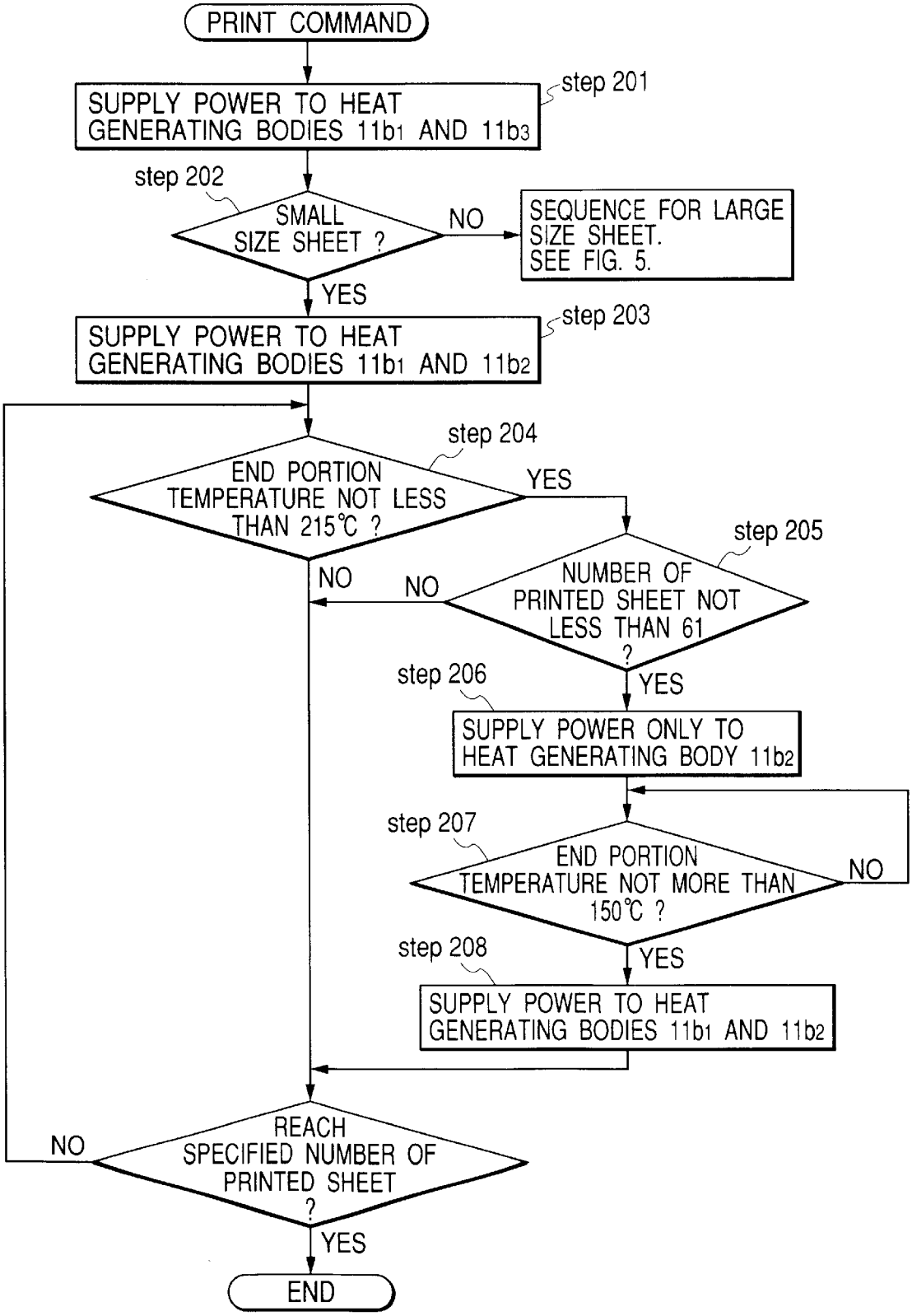
FIG. 7 is a flow chart for illustrating the drive control of each heat generating body of a heating member in a second embodiment of the present invention.

The algorism of the control of the ratio between the amounts of electric power supplied from the power source to the heat generating bodies 11$b_1$ and 11$b_2$ in the present embodiment will hereinafter be described with reference to FIG. 7.

First, electric power is supplied to the heat generating bodies 11$b_1$ and 11$b_3$ to heat the fixing nip portion N efficiently, and the fixing apparatus 6 is started (step 201). Thereafter, when it is detected that the sheet width detected by the above-described sheet width sensor is a small size sheet (such as com 10 or DL envelope) (step 202), heating and fixing are effected with electric power supplied to the heat generating bodies 11$b_1$ and 11$b_2$ (step 203). Thereafter, whether the temperature of the non-sheet-passing portion exceeds a threshold value temperature Tmax (215° C.) during the passing of the small size sheet is judged (step 204), and if it exceeds Tmax, whether the number of printed sheets is not less than 61 sheets is judged (step 205). If these two conditions are satisfied, the heat generating bodies supplied with electric power are changed over from 11$b_1$ and 11$b_2$ to 11$b_2$ only (step 206). Thereafter, whether the temperature of the non-sheet-passing portion is below a threshold value temperature Tmin (150° C.) is judged (step 207), and if it is below Tmin, the heat generating bodies supplied with electric power are changed over from 11$b_2$ only to 11$b_1$ and 11$b_2$ (step 208).

Figure 8:
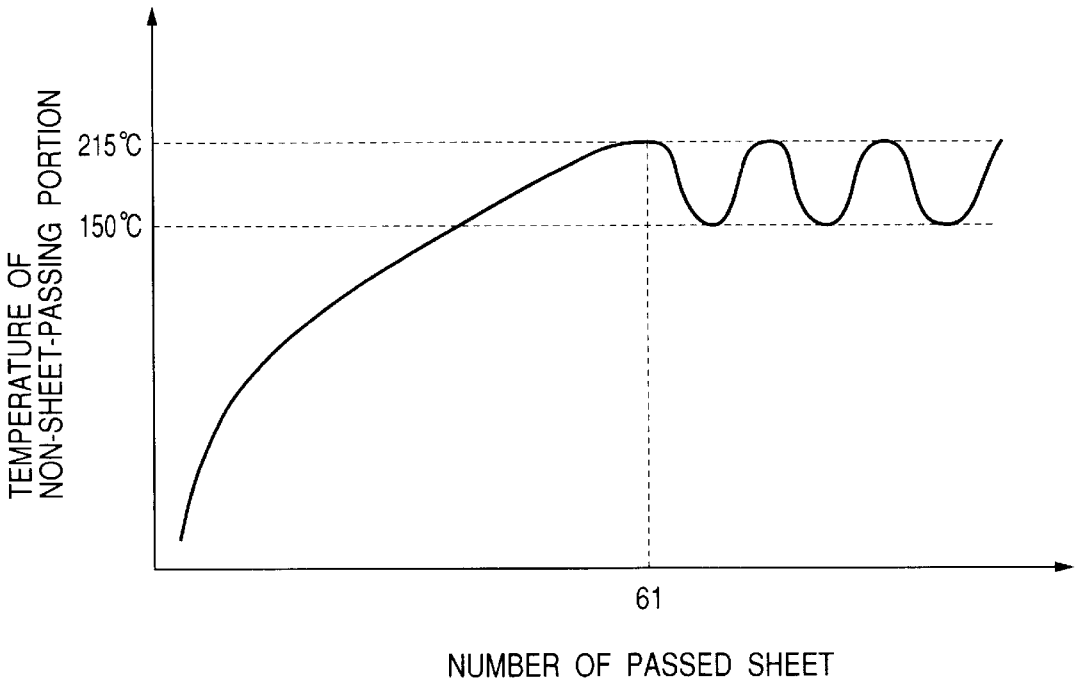
FIG. 8 is a graph showing the relation between the frequency of fixing from the start of fixing during the continuous fixing process in the second embodiment of the present invention and the temperature of the non-sheet-passing portion of the nip area.

The detected temperatures of the non-sheet-passing portion whether above-described control of the present embodiment was effected are shown in FIG. 8.

As can be seen from FIG. 8, the temperature of the non-sheet-passing portion is suppressed to 215° C. or below by such control.

The result of a test in which such control was effected to measure the passage endurance of envelopes (com 10 and DL envelopes) is shown in Table 2 below.

TABLE 2

| number of passed sheets | not controlled | controlled |
|---|---|---|
| 50k sheets | ○ | ○ |
| 100k sheets | Δ | ○ |
| 150k sheets | Δ | ○ |
| 200k sheets | x | ○ |

Table 2 above shows the result regarding the offset and the slip jam level, and x indicates "bad", Δ indicates "somewhat bad", and ○ indicates "good".

As shown in Table 2, when the third control is not effected, offset and slip jam occur before the end of the life of the fixing apparatus is reached, whereas by the third control being carried out, the problems such as offset and slip jam do not arise until the fixing apparatus reaches the end of its life. Also, even when the third control was effected, a good fixing property could be obtained by the electric power supply to only the heat generating body 11$b_2$ in a state in which the fixing apparatus was warmed as when the number of printed sheets is not less than 61 sheets.

The threshold value temperature of the non-sheet-passing area differs from that in the case of other size than the small size shown in FIG. 5, and the reason therefor is related to the position of the thermistor 15 with respect to the lengthwise direction of the heater 11 and the position of the temperature peak of the non-sheet-passing area. The temperature peak of the non-sheet-passing area occurring when a sheet of the small size (com 10 and DL) is fixed is farther from the thermistor 15 than the temperature peak of the non-sheet-passing area occurring when sheets of B5 and A5 sizes are fixed. Accordingly, by setting the threshold value temperature of the non-sheet-passing area to a lower level for the small size sheet than for other sizes, the temperature state of the non-sheet-passing area can be accurately judged irrespective of sheet sizes. If conversely to the present embodiment, the temperature peak of the non-sheet-passing area in the case of a small size sheet is nearer to the position of the thermistor 15 than that in the case of the other sizes, the threshold value temperature in the case of the small size sheet can be set to a higher level than in the case of the other sizes.

Also, as in the first embodiment, only the information of one of the detected temperature by the second thermistor 15 and the number of continuously printed sheets may be used to judge the temperature state of the non-sheet-passing area, but it is preferable to use the information of both of them because the temperature state of the non-sheet-passing area can be judged more accurately.

(Third Embodiment)

A third embodiment of the present invention will now be described. In the third embodiment, members overlapping those in the first embodiment are given the same reference characters and need not be described.

In the present embodiment, when the apparatus has a low mode (a mode in which the fixing temperature is set to a low level), a normal mode (default) and a high mode (a mode in which the fixing temperature is set to a high level) as fixing modes which are fixing conditions, the heat generating body changeover control of the above-described embodiments is not effected in the high mode, and the control of changing the threshold value temperatures Tmax and Tmin in the heat generating body changeover control to low levels is effected in the low mode. The other conditions are similar to those in the above-described embodiments.

When the above-described control of the second embodiment was effected, the fixing property of envelopes having a smooth surface could be secured, but the fixing property of bond paper and laid paper envelopes having unevenness on the surfaces thereof is somewhat reduced.

So, in the high mode, the changeover of the heat generating bodies supplied with electric power is not effected, but the heater temperature is kept high to thereby secure the fixing property.

Also, the low mode is set with its use under a low-temperature environment or the like taken into account and therefore, when the apparatus is used under an air-conditioned stable environment or when small size sheets such as thin sheets are used, a good fixing property can be obtained even in the low mode. So, in the low mode, the threshold value temperatures Tmax and Tmin of the heat generating body changeover control in the second embodiment are set to low levels and the heater temperature is made as low as possible to thereby achieve a longer life of the fixing apparatus.

Figure 9:
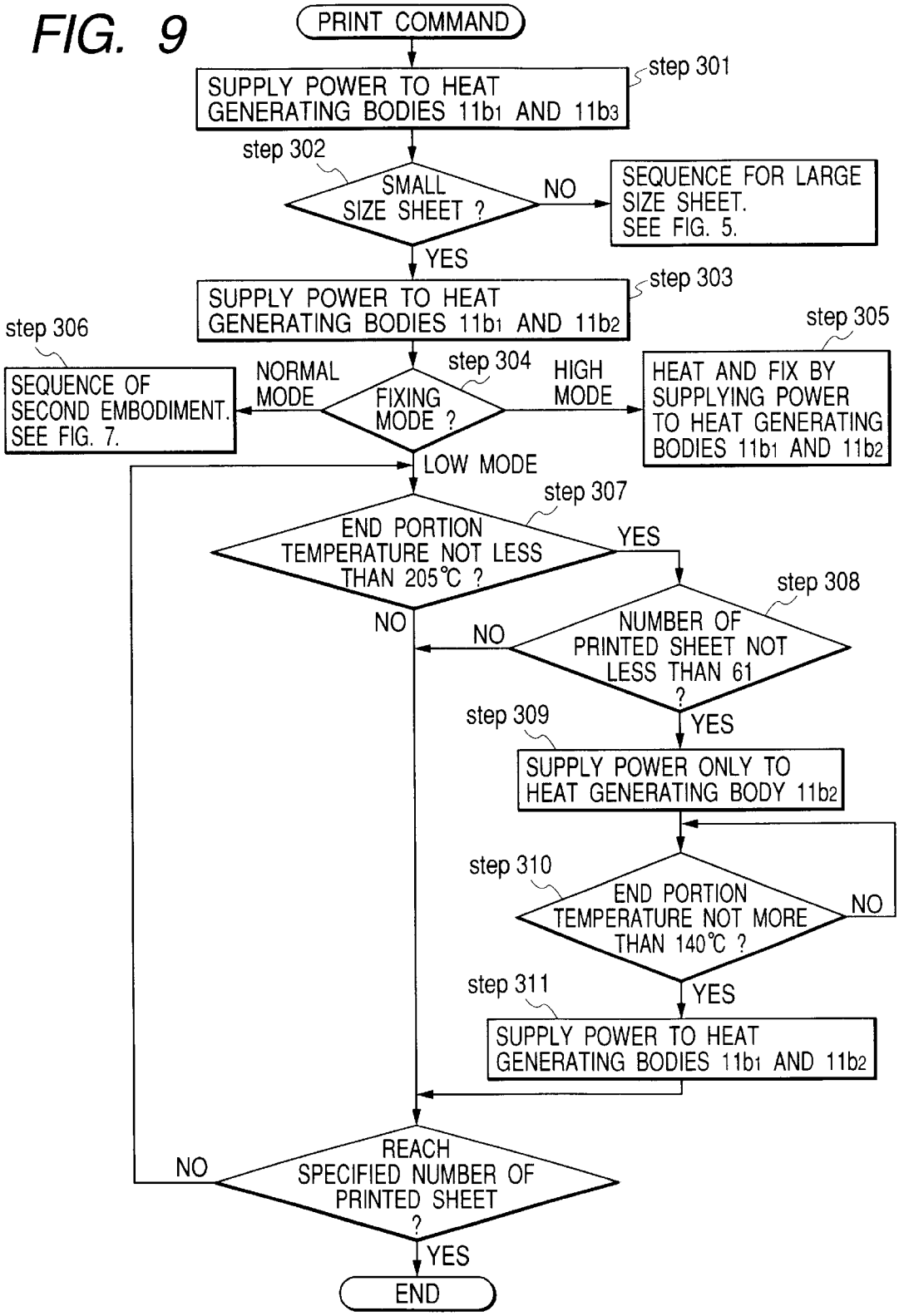
FIG. 9 is a flow chart for illustrating the drive control of each heat generating body of a heating member in a third embodiment of the present invention.
Figure 10:
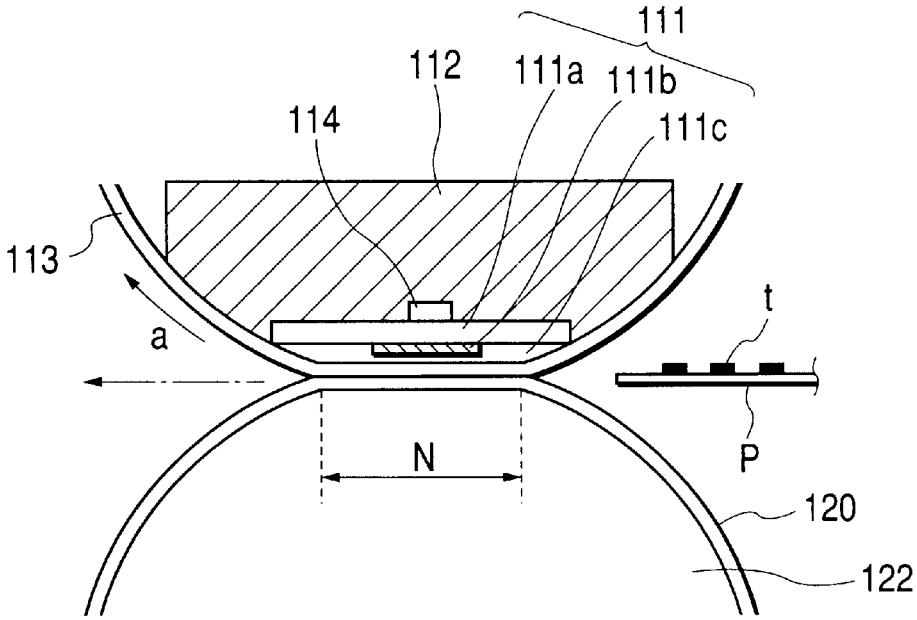
FIG. 10 is a typical cross-sectional view schematically showing the construction of the essential portions of a conventional fixing apparatus.
Figure 11:
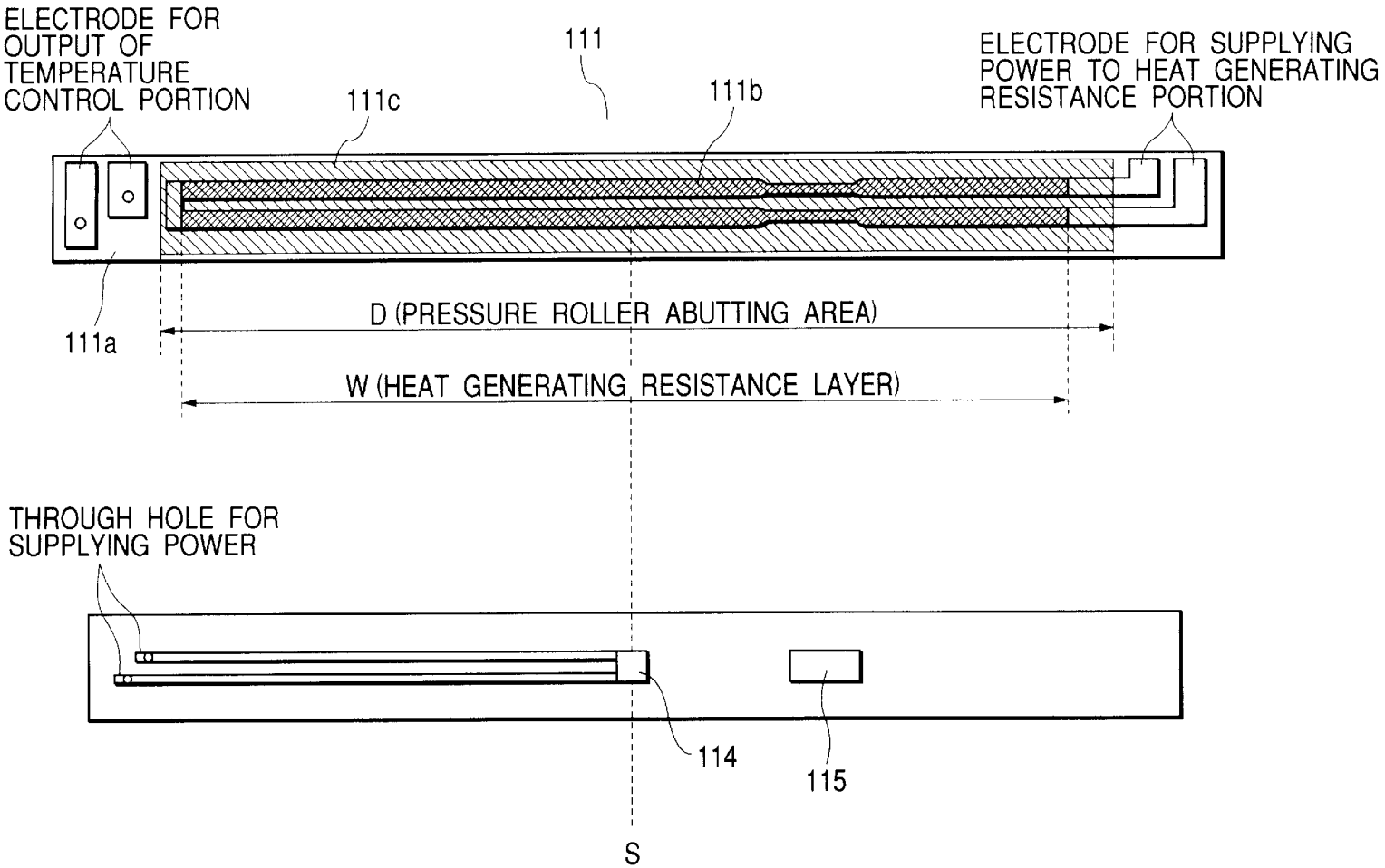
FIG. 11 is a view for schematically illustrating the construction of a heating member provided in the fixing apparatus of FIG. 10.

The control in the present embodiment will now be described with reference to FIG. 9.

First, electric power is supplied to the heat generating bodies $\mathbf{11}b_1$ and $\mathbf{11}b_3$ to heat the fixing nip portion N efficiently, and the fixing apparatus 6 is started (step 301). Next, when it is detected that the sheet width detected by the above-described sheet width sensor is that of a small size sheet (such as com 10 or DL envelope) (step 302), heating and fixing are effected with electric power supplied to the heat generating bodies $\mathbf{11}b_1$ and $\mathbf{11}b_2$ (step 303). Which of the low mode, the normal mode and the high mode the fixing mode is judged (step 304), and if it is the high mode, the changeover control of the heat generating bodies supplied with electric power is not effected, and heating and fixing are effected with electric power supplied to the heat generating bodies $\mathbf{11}b_1$ and $\mathbf{11}b_2$ (step 305). If the fixing mode is the normal mode, control similar to that of the above-described second embodiment is effected (step 306). If the fixing mode is the low mode, the threshold value temperatures are changed and the changeover control of the heat generating bodies supplied with electric power is effected. Whether the temperature of the non-sheet-passing portion exceeds the threshold value temperature Tmax (205° C.) during the supply of small size sheets is judged (step 307), and if it exceeds Tmax, whether the number of printed sheets is not less than 61 sheets is judged (step 308), and when these two conditions are satisfied, the heat generating bodies supplied with electric power are changed over from $\mathbf{11}b_1$ and $\mathbf{11}b_2$ to $\mathbf{11}b_2$ only (step 309). Thereafter, whether the temperature of the non-sheet-passing portion is below the threshold value temperature Tmin (140° C.) is judged (step 310), and if it is below Tmin, the heat generating bodies supplied with electric power are changed over from $\mathbf{11}b_2$ only to $\mathbf{11}b_1$ and $\mathbf{11}b_2$ (step 311).

The fixing property of bond paper and laid paper envelopes was confirmed by such control with a result that by designating the high mode, a good fixing property could be obtained. However, when the high mode is used to secure the fixing property of special envelopes such as bond paper and laid paper envelopes, the life of the fixing apparatus becomes shorter, but because there is also the setting of the low mode, the shortening of the life of the fixing apparatus can be suppressed.

Also, when the apparatus was used under an air-conditioned stable environment or small size sheets such as thin sheets were used, it was conformed that by designating the low mode, the life of the fixing apparatus was prolonged by the order of 30 to 50%.

While in the present embodiment, the changing of the threshold value temperatures was done by the fixing mode, the threshold value of the number of printed sheets may be changed.

Consequently, according to the present embodiment, the presence or absence of the execution of the changeover control of each heat generating body supplied with electric power and the threshold value temperatures or the threshold value number of sheets are changed by the fixing mode, whereby the compatibility of the durability in the ordinary mode using smooth sheets and the securement of the fixing property in a special case using uneven sheets and the longer life of the fixing apparatus in the low mode have become possible.

The present invention is not restricted to the above-described embodiments, but also covers modifications similar in technical idea thereto.

What is claimed is:

1. An image heating apparatus for heating an image on a recording material, comprising:

a heating member;

a first heat generating element mounted on said heating member;

a second heat generating element mounted on said heating member;

a temperature detecting element for detecting a temperature of said heating member, said temperature detecting element being disposed in an area where the recording material of a predetermined minimum size does not pass; and power supply control means for controlling an electric power supply to said first and second heat generating elements in conformity with both of a detected temperature by said temperature detecting element and number of continuously passing recording materials.

2. An image heating apparatus according to claim 1, wherein said power supply control means supplies electric power to said first and second heat generating elements irrespective of the number of passing recording materials when the detected temperature is lower than a predetermined temperature, and cuts off the electric power supply to said second heat generating element when the detected temperature becomes higher than the predetermined temperature and the number of passing recording materials becomes greater than a predetermined number.

3. An image heating apparatus according to claim 2, wherein said second heat generating element is disposed downstream of said first heat generating element with respect to a direction of movement of the recording material.

4. An image heating apparatus according to claim 2, wherein lengths of said first and second heat generating elements in a longitudinal direction thereof are substantially equal to each other.

5. An image heating apparatus according to claim 2, wherein a length of said second heat generating element in a longitudinal direction thereof is greater than that of said first heat generating element.

6. An image heating apparatus according to claim 1, further comprising a film adapted to be moved while contacting with said heating member, and wherein said heating member heats the image through said film.

7. An image heating apparatus for heating an image on a recording material, comprising:

a heating member;

a first heat generating element mounted on said heating member; and a second heat generating element mounted on said heating member;

wherein when a temperature of an area of said heating member where the recording material of a predetermined minimum size does not pass is lower than a predetermined temperature, said first and second heat generating elements generate heat, and when the temperature of the area becomes higher than the predetermined temperature and number of continuously passing recording materials becomes greater than a predetermined number, said first heat generating element continues to generate heat and said second heat generating element stops generating heat.

8. An image heating apparatus according to claim 7, wherein said second heat generating element is disposed downstream of said first heat generating element with respect to a direction of movement of the recording material.

9. An image heating apparatus according to claim 7, wherein lengths of said first and second heat generating elements in a longitudinal direction thereof are substantially equal to each other.

10. An image heating apparatus according to claim 7, wherein a length of said second heat generating element in a longitudinal direction thereof is greater than that of said first heat generating element.

11. An image heating apparatus according to claim 7, further comprising a film adapted to be moved while contacting with said heating member, and wherein said heating member heats the image through said film.

12. An image heating apparatus for heating an image on a recording material, comprising:

a heating member;

a first heat generating element mounted on said heating member;

a second heat generating element mounted on said heating member, a width of said second heat generating element in a longitudinal direction thereof being substantially equal to that of said first heat generating element;

wherein when a temperature of an area of said heating member where the recording material of a predetermined minimum size does not pass is lower than a predetermined temperature, said first and second heat generating elements generate heat, and when the temperature of the area is higher than the predetermined temperature, said second heat generating element does not generate heat, but said first heat generating element generates heat.

13. An image heating apparatus according to claim 12, wherein said second heat generating element is disposed downstream of said first heat generating element with respect to a direction of movement of the recording material.

14. An image heating apparatus according to claim 12, further comprising a film adapted to be moved while contacting with said heating member, and wherein said heating member heats the image through said film.

15. An image heating apparatus for heating an image on a recording material, comprising:

a heating member;

a plurality of heat generating elements mounted on said heating member;

transfer control means for controlling a transfer of the recording materials, said transfer control means decreasing number of sheets conveyed per unit-time when a temperature of an area of said heating member where the recording material of a predetermined minimum size does not pass rises; and power supply control means for controlling an electric power supply to said plurality of heat generating elements, said power supply control means decreasing number of said plurality of heat generating elements which generate heat when the temperature of said area of said heating member rises.

* * * * *

UNITED STATES PATENT AND TRADEMARK OFFICE

CERTIFICATE OF CORRECTION

PATENT NO. : 6,580,883 B2
DATED : June 17, 2003
INVENTOR(S) : Masahiko Suzumi

It is certified that error appears in the above-identified patent and that said Letters Patent is hereby corrected as shown below:

Column 1,
Line 55, “arrow,” should read -- the arrow, --.

Column 2,
Line 3, “electrically” should read -- electric --.
Line 4, “insulativeness,” should read -- insulation properties, --.
Line 17, “heat” should read -- heats --.
Line 58, “formes” should read -- forms --.

Column 4,
Line 17, “I11” should read -- 111 --.

Column 7,
Line 13, “arrow,” should read -- the arrow, --.

Column 8,
Line 28, “11b,” should read -- $11b_1$ --.
Line 34, “arrow.” should read -- the arrow. --.

Column 9,
Line 23, “(con” should read -- (com --.

Column 11,
Line 23, “of” should read -- to --.

Signed and Sealed this

Second Day of December, 2003

JAMES E. ROGAN
*Director of the United States Patent and Trademark Office*